US010586416B2

(12) United States Patent
Rennie et al.

(10) Patent No.: US 10,586,416 B2
(45) Date of Patent: Mar. 10, 2020

(54) MEDIA ESCROW WITH DYNAMIC DRUM POSITIONING

(71) Applicant: NCR Corporation, Duluth, GA (US)

(72) Inventors: Michael McLeod Rennie, Fife (GB); Scott Low Colston, Dundee (GB)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 15/824,722

(22) Filed: Nov. 28, 2017

(65) Prior Publication Data

US 2019/0164375 A1 May 30, 2019

(51) Int. Cl.

| | |
|---|---|
| ***B65H 5/28*** | (2006.01) |
| ***G07D 11/16*** | (2019.01) |
| ***B65H 29/12*** | (2006.01) |
| ***B65H 29/60*** | (2006.01) |
| ***B65H 7/18*** | (2006.01) |
| ***G07D 11/13*** | (2019.01) |
| ***G07D 11/40*** | (2019.01) |
| *G07F 19/00* | (2006.01) |

(52) U.S. Cl.

CPC ..... *G07D 11/16* (2019.01); *B65H 7/18* (2013.01); *B65H 29/125* (2013.01); *B65H 29/60* (2013.01); *G07D 11/13* (2019.01); *G07D 11/40* (2019.01); *B65H 2701/1912* (2013.01); *G07F 19/202* (2013.01); *G07F 19/203* (2013.01)

(58) Field of Classification Search

CPC ..... B65H 5/28; B65H 29/006; B65H 2301/41912

See application file for complete search history.

(56) References Cited

U.S. PATENT DOCUMENTS

| | | | | |
|---|---|---|---|---|
| 8,893,921 | B2 * | 11/2014 | Miki | B65H 29/006 221/71 |
| 2013/0081922 | A1 * | 4/2013 | Amo | B65H 29/006 194/206 |

* cited by examiner

*Primary Examiner* — Luis A Gonzalez

(74) *Attorney, Agent, or Firm* — Schwegman, Lundberg & Woessner

(57) ABSTRACT

An escrow module of a valuable media depository is configured to self-adjust the position of an escrow drum relative to an escrow pinch. The media is maintained within the pinch as the escrow module takes in media items and returns media items by the self-adjusting positions of the escrow drum. As the drum fills up with media items, the drum is moved away from the escrow pinch while maintained a consistent media path and providing consistent performance regardless of the number of media items being processed in a transaction to and from the drum.

14 Claims, 10 Drawing Sheets

MEDIA ESCROW WITH DYNAMIC DRUM POSITIONING

BACKGROUND

Often, media handing devices use drum storage escrows to hold notes while a transaction is authorized. All these escrow devices suffer from a common weakness in their design, which makes them prone to jams. The position of the drum is set to accommodate a maximum transaction size but, the vast majority transactions are much smaller.

In fact, existing escrow devices attempt to transport the media across a distance between the drive and drum that is typically 1.5 to 2 times the normal transport pitch. This is forced by the change in size of the escrow drum as the drum moves from empty to full. The drum must be far enough away from the media transport exit to provide clearance even when the drum is at its full capacity. Consequently, jams in conventional escrow devices are always a series maintenance issue in the media handling device. Usually, second line service calls are initiated for support personnel, and the escrow device is typically damaged.

The media is often fired from its position on the drum, but when the drum is too far away from the media exit, there is a hope that the media will properly get to the exit without jamming the escrow device. The drum remains fixed during transactions, which is a major issue for many conventional transactions.

As a result, conventional escrow devices are problematic and service intensive modules within media handling devices.

SUMMARY

In various embodiments, methods and a valuable media depository for media escrow with dynamic drum positioning are provided.

According to an embodiment, a method for media escrow with dynamic drum positioning is presented. Specifically, a drum of an escrow module is dynamically positioned as media items are added to the drum and as the media items are removed from the drum. A constant distance is maintained from an outer peripheral surface of the drum holding the media items to a pinch of the escrow module as the drum is dynamically positioned.

DETAILED DESCRIPTION

Figure 1A:
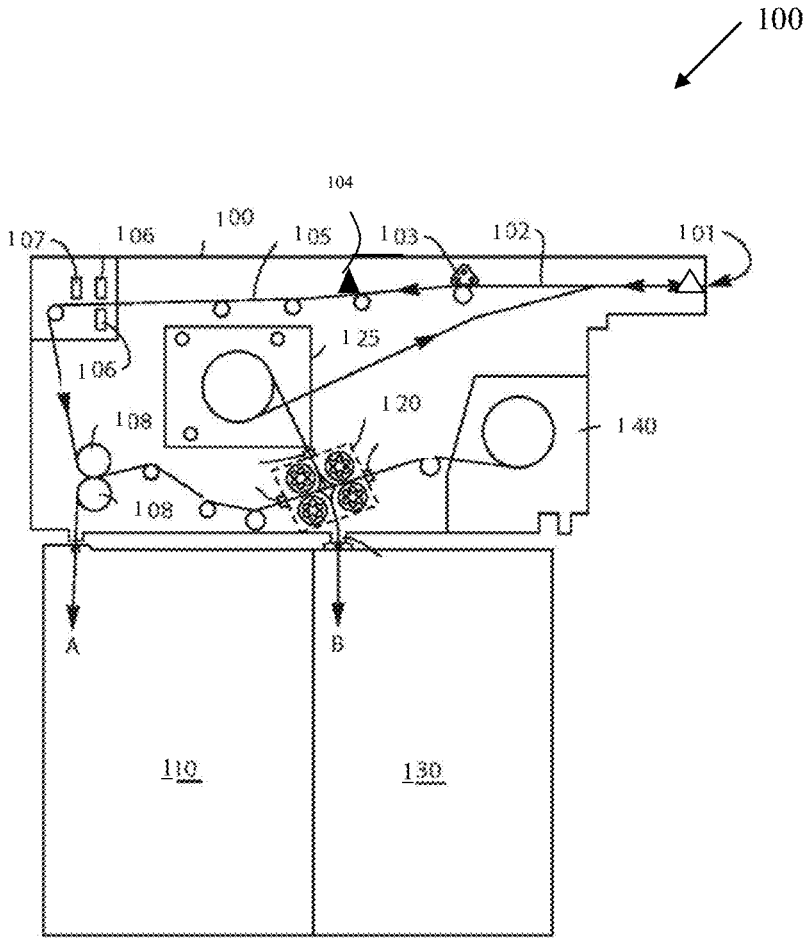
FIG. 1A is a diagram depicting a deposit module of a Self-Service Terminal (SST) having an escrow module, according to an example embodiment.

FIG. 1A is a diagram depicting a one-sided view of a valuable media depository 100, according to an example embodiment (also referred to as a deposit module). It is to be noted that the valuable media depository is shown with only those components relevant to understanding what has been added and modified to a conventional depository for purposes of providing dynamic escrow drum positioning within the depository 100.

The depository 100 is suitable for use within an Automated Teller Machine (ATM), which can be utilized to process deposited banknotes and checks (valuable media as a mixed bunch if desired). The deposit module 100 has an access mouth (media or document infeed) where an infeed module 101 processes and through which incoming checks and/or banknotes (windowed and non-windowed) are deposited or outgoing checks and/or banknotes are dispensed. This mouth is aligned with an infeed aperture in the fascia of the ATM in which the depository 100 is located, which thus provides an input/output slot to the customer. A bunch (stack) of one or more items (valuable media) is input or output. Incoming checks and/or banknotes follow a first transport path 102 away from the mouth in a substantially horizontal direction from right to left shown in the FIG. 1A. They then pass through a separator module 103 and from the separator 103 to a deskew module 104 along another pathway portion 105, which is also substantially horizontal and right to left. The items are now de-skewed and aligned for reading by imaging cameras 106 and a Magnetic Ink Character Recognition (MICR) reader 107.

Items are then directed substantially vertically downwards to a point between two nip rollers 108. These nip rollers cooperate and are rotated in opposite directions with respect to each other to either draw deposited checks and/or banknotes inwards (and urge those checks and/or banknotes towards the right hand side in the FIG. 1A), or during another mode of operation, the rollers can be rotated in an opposite fashion to direct processed checks and/or banknotes downwards in the direction shown by arrow A in the FIG. 1A into a check or banknote bin 110. Incoming checks and/or banknotes, which are moved by the nip rollers 108 towards the right, enter a diverter mechanism 120. The diverter mechanism 120 can either divert the incoming checks and/or banknotes upwards (in the FIG. 1A) into a re-buncher unit 125, or downwards in the direction of arrow B in the FIG. 1A into a cash bin 130, or to the right hand side shown in the FIG. 1A into a novel escrow 140 (shown and discussed in greater detail below in the FIGS. 1B-1F and 2-4 below). Items of media from the escrow 140 can selectively be removed from the drum and re-processed after temporary storage. This results in items of media moving from the escrow 140 towards the left hand side of the FIG. 1A where again they will enter the diverter mechanism 120. The diverter mechanism 120 can be utilized to allow the transported checks (a type of valuable media/document) and/or banknotes (another type of valuable media/document) to move substantially unimpeded towards the left hand side and thus the nip rollers 108 or upwards towards the re-buncher 125. Currency notes from the escrow 140 can be directed to the re-buncher 125 or downwards into the banknote bin 130.

As used herein, the phrase "valuable media" refers to media of value, such as currency, coupons, checks, negotiable instruments, value tickets, and the like.

For purposes of the discussions that follow with respect to the FIGS. 1A-1G and 2-4, "valuable media" is referred to as currency and the "valuable media depository" is referred to as a "depository." Additionally, valuable media may be referred to as a "document" herein.

Figure 1B:
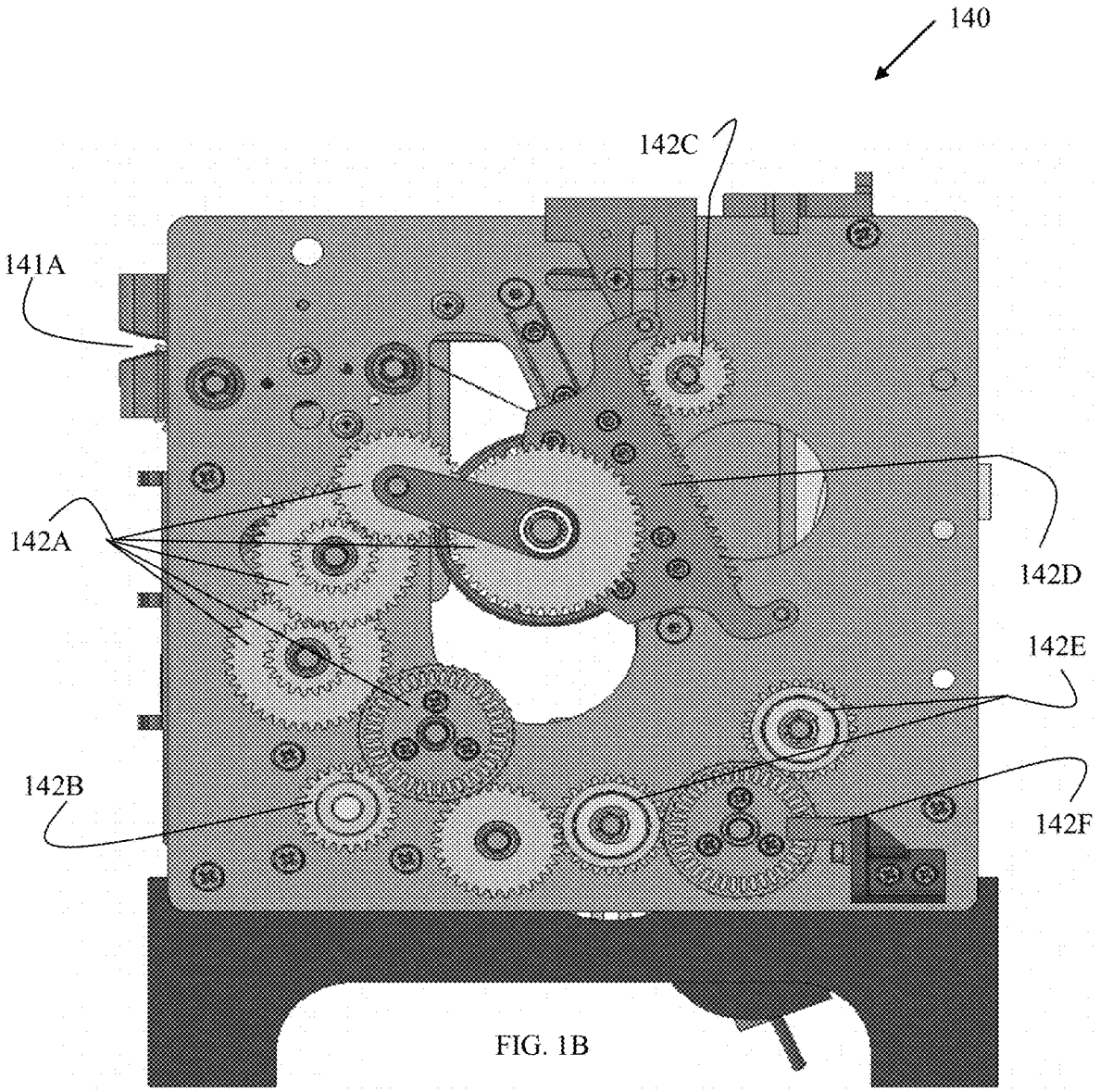
FIG. 1B is a right-side view of the escrow module, according to an example embodiment.

FIG. 1B is a right-side view of the escrow module 140, according to an example embodiment.

The transport interface 141A provides media items for holding within the escrow module 140 from the transport path interfaced to the diverter mechanism 120 within the depository 100 during transactions with the depository 100. The escrow module 140 also returns media items for transactions through the transport interface 141A along the transport path to the diverter mechanism 120.

As the media items are received within the escrow module 140, the media items are wrapped around the outside of the drum 145A and held in place along the outside peripheral of the drum 145A by tape 144A. As more media items are received for a transaction, the diameter of the drum 145A increases.

Conventionally, the drum remains in a fixed position and at a distance away from the pinch of the transport interface (entry and exit point) believed to be sufficient to handle a maximum amount of media items for a transaction. This creates problems as discussed above for most transaction that never reach the significant number of media items needed to fill the drum.

The escrow module 140 includes a dynamic positioning of the drum 145A. The initial positioning of the drum 145A is adjacent or next to the pinch 141C of the transport interface 141A (media entry/exit point). This initial configuration is opposite of what is done in conventional approaches (where the drum in a fixed and constant position at a maximum distance away from a conventional pinch.

The escrow module 140 is driven downward within the escrow module as media items fill the drum 145A. The drum 145A is attached to a drum lift rack 142D that is driven up and down by a drum lift motor (stepper motor) 1456. The direction of the movement and positioning of the drum 145A is vertically (up and down) and within a slight inclined angle.

When media items are returned from the escrow module 140 from the drum 145A, the drum 145A remains adjacent to the pinch 141C of the transport interface 141A substantially reducing the likelihood for any jamming within the escrow module 140, which is a significant issue with conventional escrow modules. As media items are returned for exiting the escrow module 140, the stepper motor 145B urges or drives the drum 145A upward along the drum lift rack 142D towards the pinch 141C of the transport interface 141A (media exit).

With this initial context on the novel escrow module 140 with dynamic drum 145A positioning, the right-sided view of the escrow module 140 is now discussed.

The components depicted in the FIG. 1B include the transport interface 141A, the drum rotation gear train 142A, the drum rotation motor 142B, a drum lift pinion 142C, the drum lift rack 142D, the tape reel drive gear train 142E, and a drum rotation encoder (rotational drum speed control).

Figure 1C:
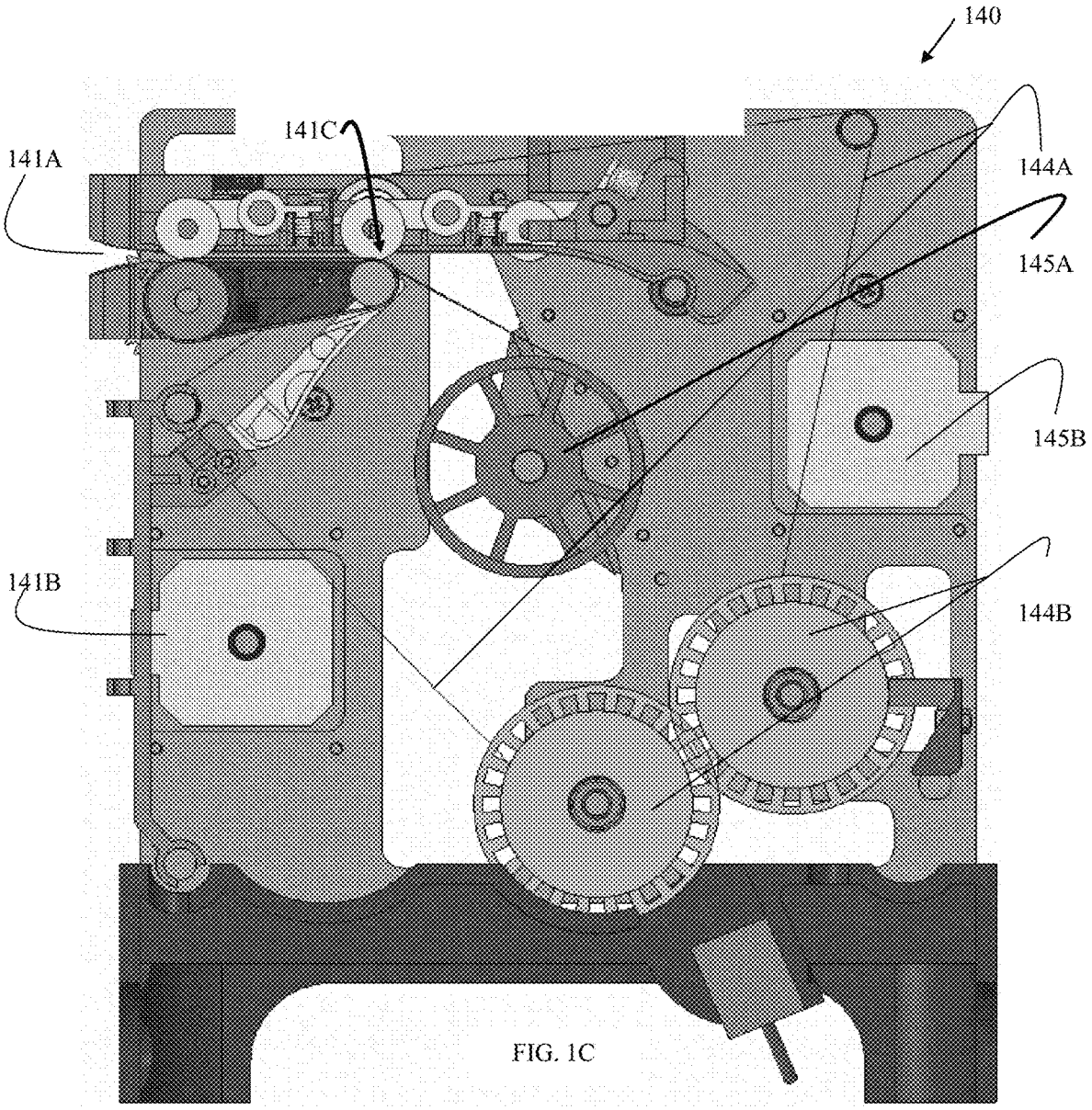
FIG. 1C is a right-side view of the escrow module with the drum at a lower position, according to an example embodiment.

FIG. 1C is a right-side view of the escrow module 140 with the drum at a lower position, according to an example embodiment.

The drum 145A is in a lower position indicating a drum with a decent amount media items for a given example transaction has caused the drum 145A to be driven downward further away from the pinch 141C.

The FIG. 1C also illustrates the input transport stepper motor 141B, the tape 144A, the tape reels 144B, the drum 145A (at the lowered position), and the drum lift motor (stepper motor) 145B.

The drum lift motor 145B urges the drum 145A to the lowered position by urging the drum 145A along the drum lift rack 145B downward and away the pinch 141C. The distance from the drum 145A to the pinch 141C is dependent upon how full the drum 145A is with media items (dependent on the number of media items being processed for the transaction).

Figure 1D:
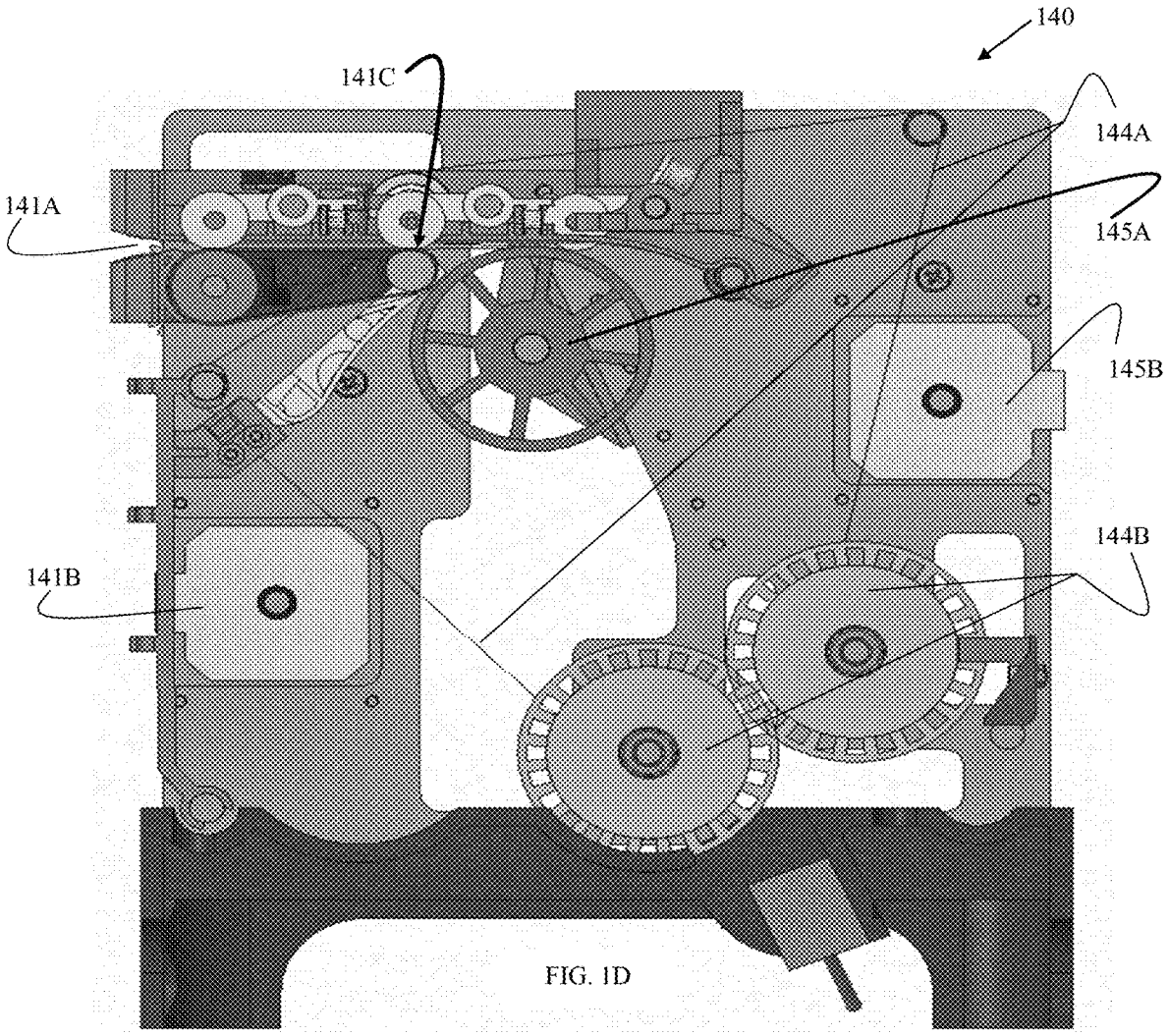
FIG. 1D is right-side cross sectional view of the escrow module with the drum at an upper position, according to an example embodiment.

FIG. 1D is right-side cross sectional view of the escrow module 140 with the drum at an upper position, according to an example embodiment.

The drum 145A is in an upper position adjacent to the pinch (exit) 141C. This position indicates that the drum 145A is empty (with no media items) or has few media items for the given transaction.

In this position, the drum lift motor 1445B urges the drum 145A to the upper position by urging/moving the drum 145A upward along the drum lift rack 145B toward the pinch (exit) 141C.

The FIG. 1D also similar components as was illustrated in the FIG. 1C.

Figure 1E:
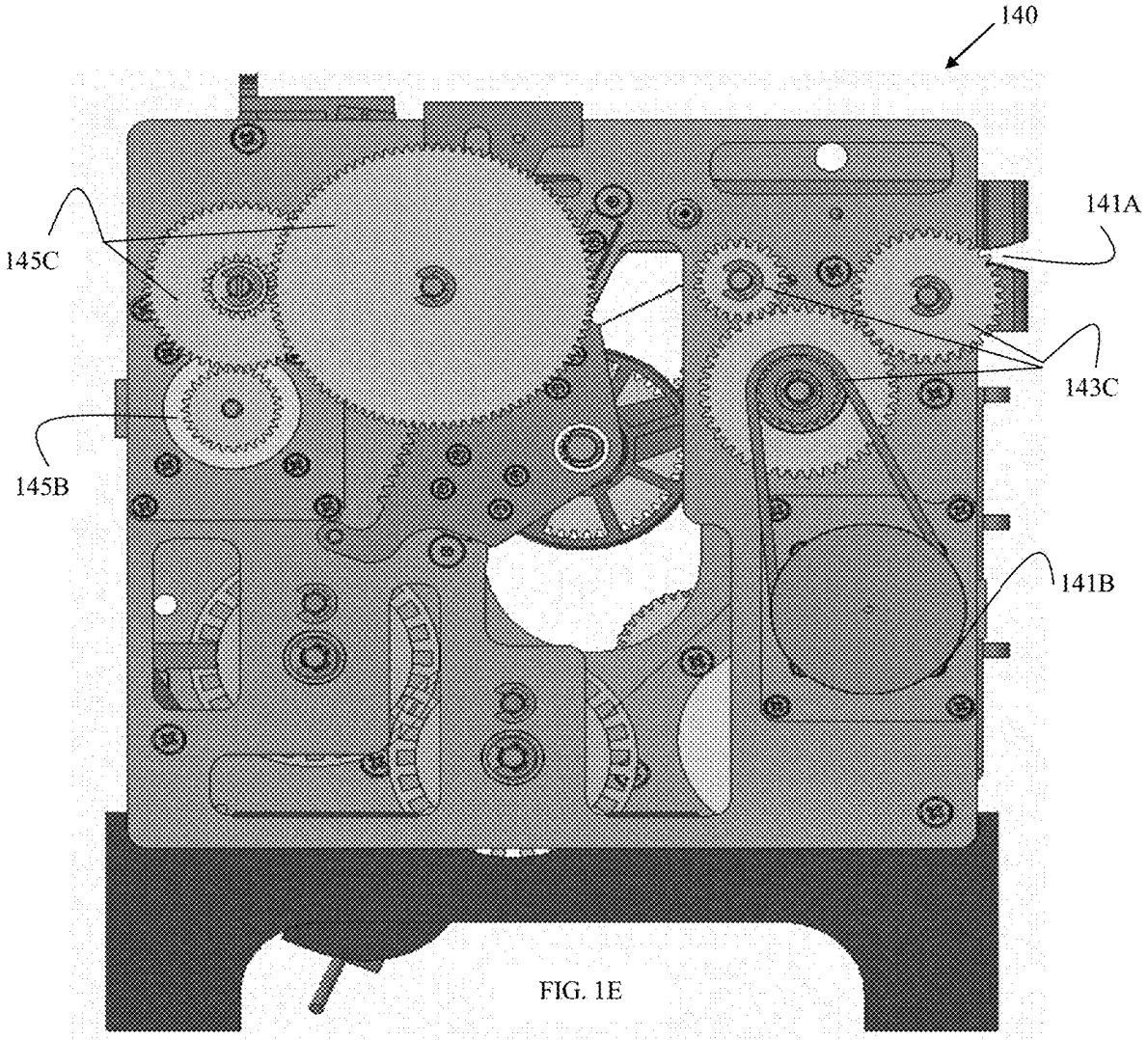
FIG. 1E is a left-side view of the escrow module, according to an example embodiment.

FIG. 1E is a left-side view of the escrow module 140, according to an example embodiment.

FIG. 1E illustrates the drum lift gear train 145C, the drum lift motor 145B, the transport gear train 143C, and the transport motor 141B from the left-sided view.

Figure 1F:
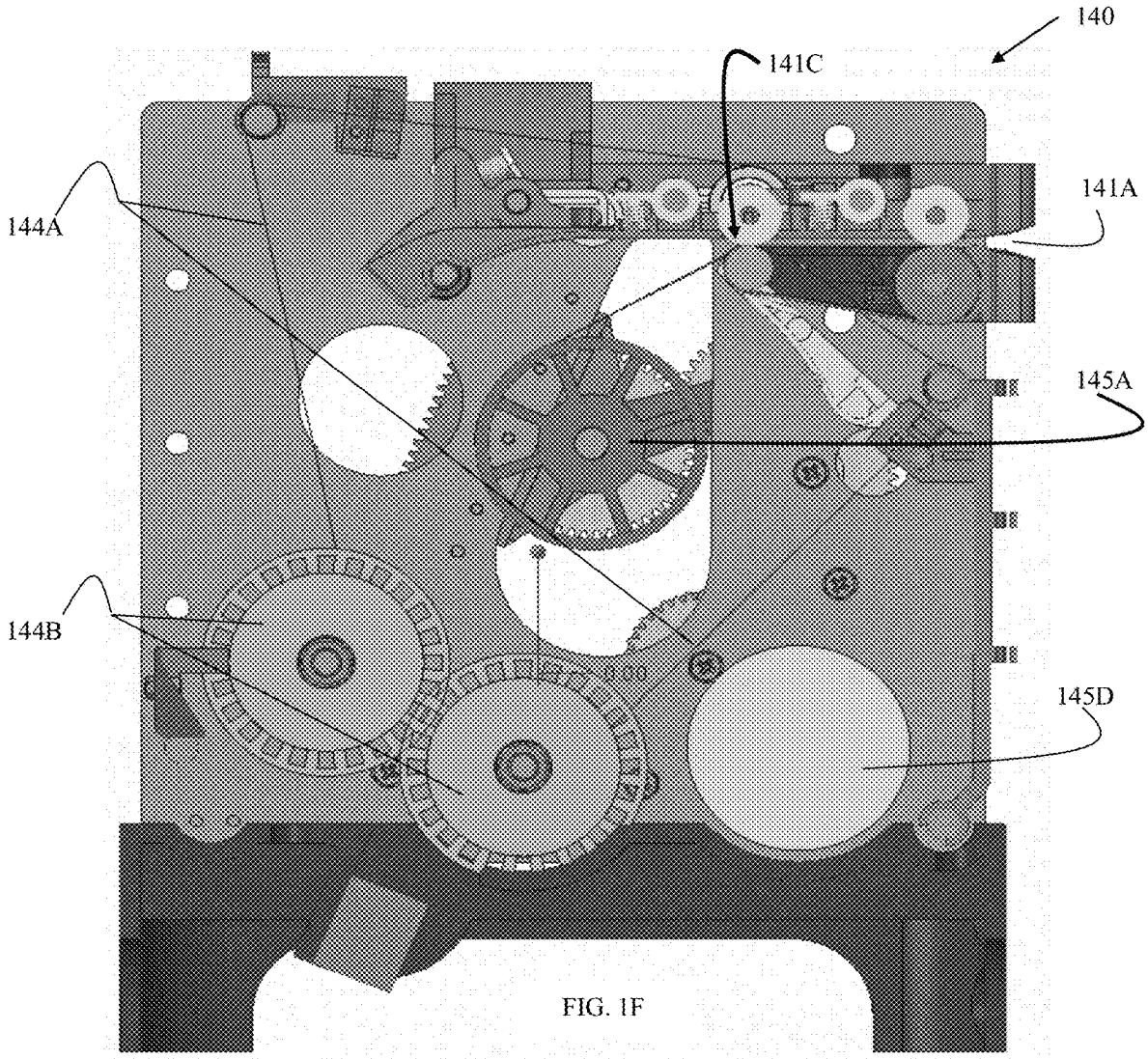
FIG. 1F is a left-side cross sectional view of the escrow module, according to an example embodiment.

FIG. 1F is a left-side cross sectional view of the escrow module 140, according to an example embodiment.

FIG. 1F illustrates the tape 144A, the tape reels 144B, the drum 145A, and the drum rotation motor 145D (that controls the rotational movement of the drum 145A).

Figure 1G:
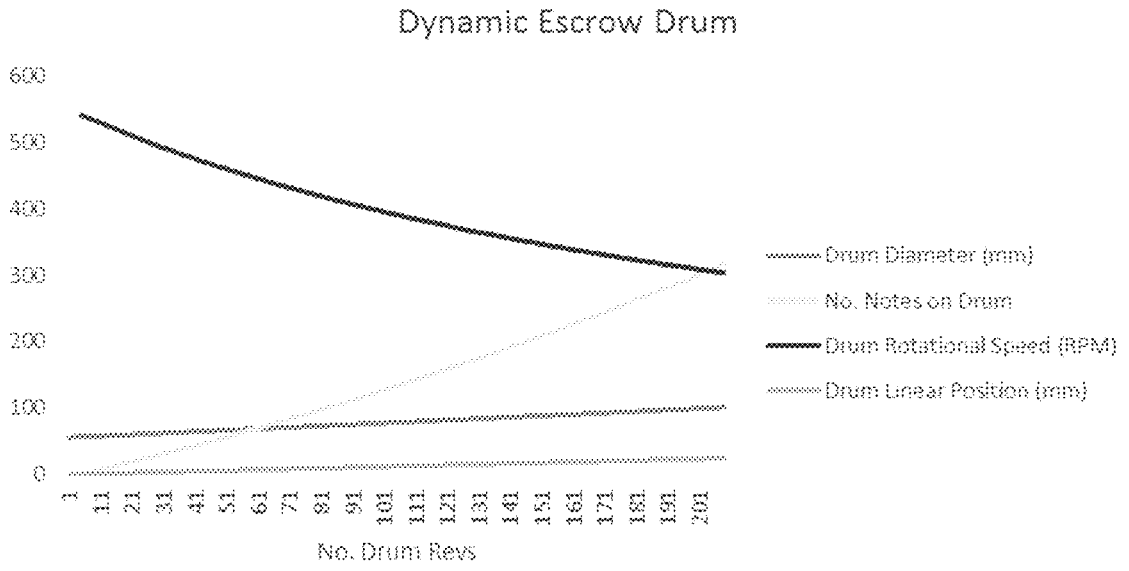
FIG. 1G is a chart depicting the escrow drum's revolutions relative to: the number of notes on the drum, drum diameter (mm), drum rotational speed (rpm), and the drum's linear position (mm) from the pinch to the outside of the drum, according to an example embodiment.

FIG. 1G is a chart depicting the escrow drum's revolutions relative to: the number of notes on the drum, drum diameter (mm), drum rotational speed (rpm), and the drum's linear position (mm) from the pinch 141C to the outside of the drum, according to an example embodiment.

The X axis of the chart identifies the drum revolutions from 0 to 208.

The Y axis represents different units based on the plotted lines. The units can include the drum's diameter in millimeters (mm), integer numbers for the number of notes on the drum, the drum rotational speed in revolutions per minute (rpm), and the drum's linear position in mm.

The drum diameter ranges from 56 mm (when empty) to 100 mm (when full).

The number of notes range from 0 notes (when the drum is empty) to 300 notes (when the drum is full or at capacity).

The drum rotational velocity ranges from 540 rpm (when the drum is empty) to 303 rpm (when the drum is full). Drum rotational velocity is adjusted to maintain a constant linear velocity as the diameter of the drum increases/decreases when notes are added/removed.

The drum linear position ranges from 1 mm (initial position when the drum is empty) to 22.71 mm (when the drum is at capacity and full of media notes (media items). The drum position is adjusted to maintain a constant distance from the pinch 141C to the outside surface of the drum that holds the notes as the drum diameter increases/decreases due to notes being added/removed.

One now appreciates how a dynamic positioning of the drum 145A of an escrow module 140 can be urged toward the pinch 141C of the media entry/exit as the drum 145A removes media items from the drum, and urged away from the pinch 141C as media items are added to the drum 145A. The outer surface and peripheral surface of the drum 145A maintains a constant distance from the pinch 141C ensuring media items can exit from the drum through the transport interface 141A adjacent to the pinch 141C at all times. Conventionally, this was not done and the drum maintained a constant fixed position regardless of the number of notes that filled or were removed from the drum, which created significant and frequent jamming in conventional escrow modules.

The embodiments discussed above and other embodiments are now discussed with reference to the FIGS. 2-4.

Figure 2:
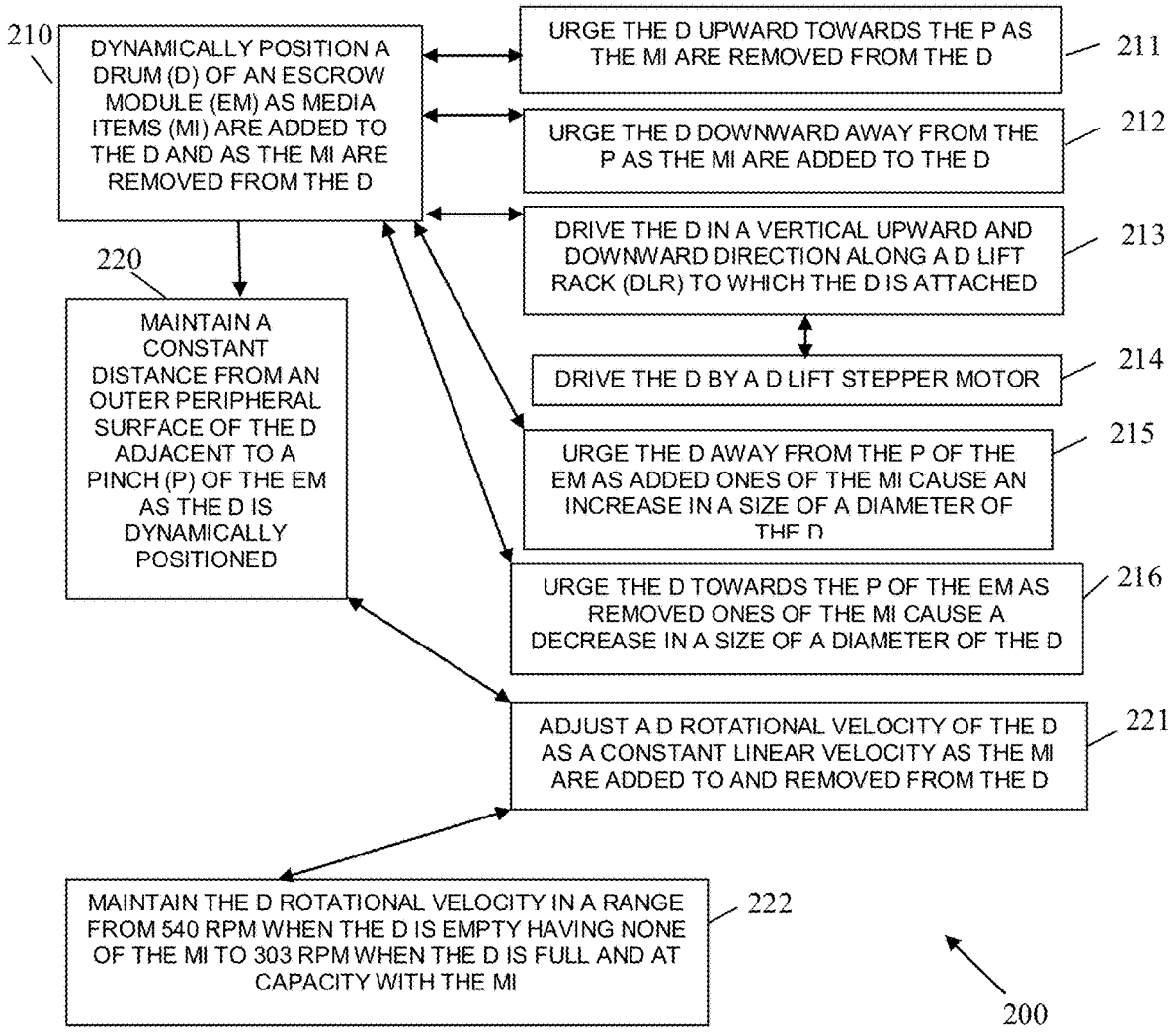
FIG. 2 is a diagram of a method for dynamic drum positioning, according to an example embodiment.

FIG. 2 is a diagram of a method 400 for dynamic drum positioning performed by an escrow of a valuable media depository, according to an example embodiment. The method 200 when processed controls drum position relative to the exit based on the number of media items on the drum. The escrow module/device performs the processing.

In an embodiment, the escrow module is the escrow module 140 depicted above in the FIGS. 1A-1F.

In an embodiment, the method 200 performs the dynamic drum positioning discussed above with the FIGS. 1A-1F.

In an embodiment, the valuable media depository is a deposit module.

In an embodiment, the valuable media depository is a recycler module.

In an embodiment, the valuable media depository is a peripheral device integrated into an SST. In an embodiment, the SST is an ATM. In an embodiment, the SST is a kiosk.

In an embodiment, the valuable media depository is a peripheral device integrated into a Point-Of-Sale (POS) terminal.

In an embodiment, the method 200 is implemented as a controller that executes on a processor of the valuable media depository as executable instructions programmed in non-transitory computer-readable memory and/or storage. In an embodiment, the controller executes on a processor embedded in the escrow module.

At 210, a drum of the escrow module is dynamically positioned as media items are added to the drum and as the media items are removed/ejected from the drum.

According to an embodiment, at 211, the drum is urged upward towards a pinch (entry/exit mechanism) of the escrow module as the media items are removed from the drum.

In an embodiment, at 212, the drum is urged downward away from the pinch as the media items are added to the drum.

In an embodiment, at 213, the drum is driven in a vertical upward and downward direction along a drum lift rack to which the drum is attached. In an embodiment, the drum lift rack is the drum lift rack 142D.

In an embodiment of 213 and at 214, the drum is driven by a drum lift step motor. In an embodiment, the drum lift step motor is the drum lift step motor 145B.

In an embodiment, at 215, the drum is urged away from the pinch of the escrow module as added ones of the media items cause an increase in a size of a diameter of the drum.

In an embodiment, at 216, the drum is urged towards the pinch of the escrow module as removed ones of the media items cause a decrease in a size of a diameter of the drum.

At 220, a constant distance from an outer peripheral surface of the drum adjacent to a pinch is maintained as the drum is dynamically positioned within the escrow module.

In an embodiment, at 221, a drum rotational velocity of the drum is adjusted as a constant lineal velocity and as the media items are added to and removed from the drum.

In an embodiment of 221 and at 222, the drum rotational velocity is maintained in a range from 540 rpm when the drum is empty having none of the media items to 303 rpm when the drum is full and at capacity with the media items.

Figure 3:
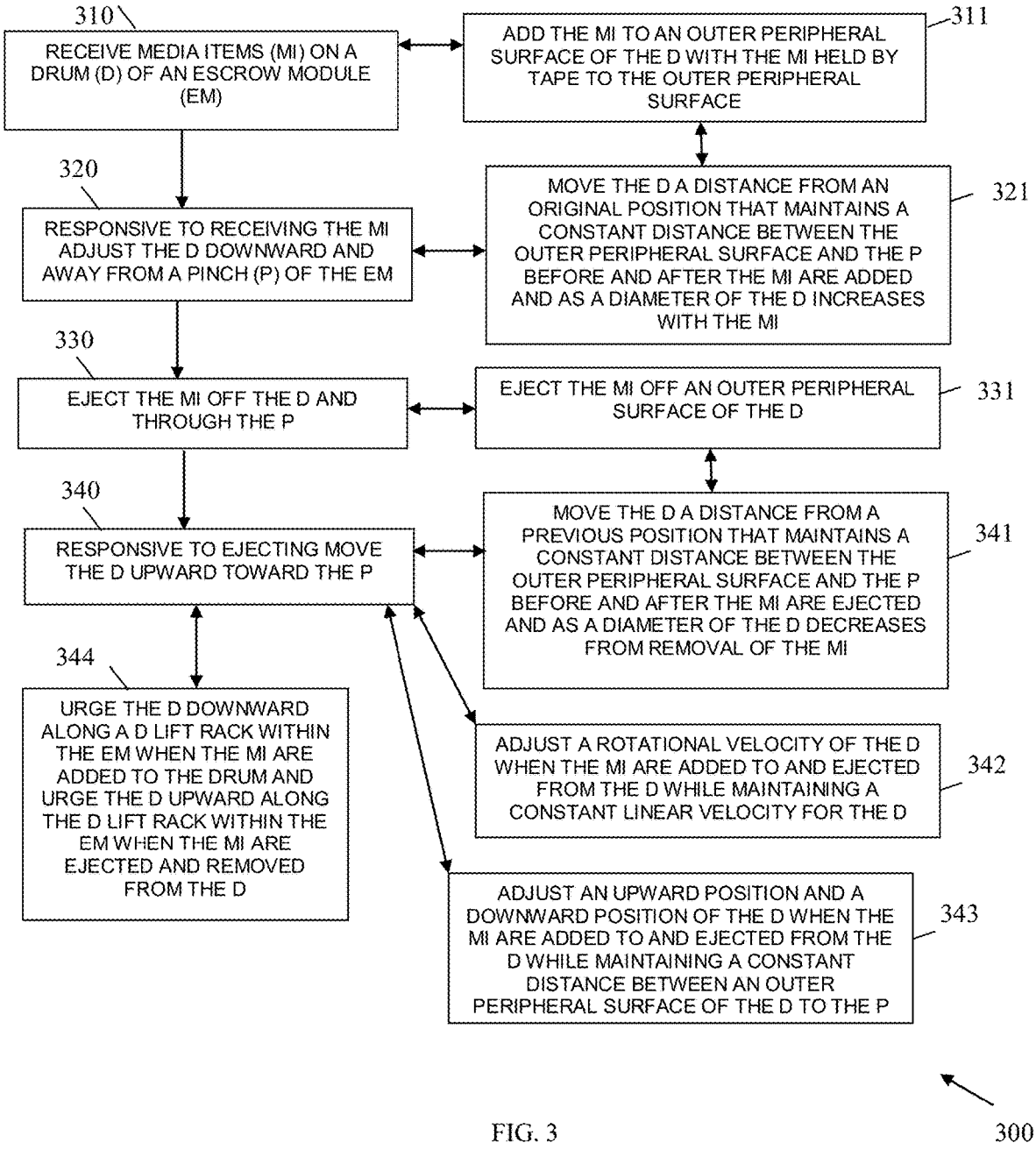
FIG. 3 is a diagram of another method for dynamic drum positioning

FIG. 3 is a diagram of another method 500 for dynamic drum positioning performed by an escrow module of a valuable media depository, according to an example embodiment. The method 500 when processed controls the escrow's drum positioning relative to the pinch within a valuable media depository. The method 300 is performed by the escrow module/device.

In an embodiment, the escrow module is the escrow module 140 of the FIGS. 1A-1F.

In an embodiment, the escrow module is the escrow module that performs the dynamic drum positioning in the method 200.

The FIG. 3 presents another and in some ways enhanced perspective to the FIG. 2.

In an embodiment, the method 300 performs the dynamic drum positioning discussed above with the FIGS. 1A-1F and 2.

In an embodiment, the valuable media depository is a deposit module.

In an embodiment, the valuable media depository is a recycler module.

In an embodiment, the valuable media depository is a peripheral device integrated into an SST. In an embodiment, the SST is an ATM. In an embodiment, the SST is a kiosk.

In an embodiment, the valuable media depository is a peripheral device integrated into a Point-Of-Sale (POS) terminal.

In an embodiment, the method 300 is implemented as a controller that executes on a processor of the valuable media depository as executable instructions programmed in non-transitory computer-readable memory and/or storage. In an embodiment, the controller executes on a processor embedded in the escrow module.

At 310, media items are received on a drum of an escrow module.

In an embodiment, at 311, the media items are added to an outer peripheral surface of the drum with the media items held by tape to the outer peripheral surface.

At 320, responsive to receiving the media items, the drum is adjusted downward and away from a pinch of the escrow module.

In an embodiment of 311 and 320, at 321, the drum is moved a distance from an original position that maintains a constant distance between the outer peripheral surface and the pinch before and after the media items are added and as a diameter of the drum increases with the media items.

At 330, the media items are ejected off the drum and through the pinch.

In an embodiment, at 331, the media items are ejected off an outer peripheral surface of the drum.

At 340, responsive to ejecting the media items, the drum is moved upward toward the pinch.

In an embodiment of 331 and 340, at 341, the drum is moved a distance from a previous position that maintains a constant distance between the outer peripheral surface and the pinch before and after the media items are ejected and as a diameter of the drum decreases from removal of the media items.

In an embodiment, at 342, a rotational velocity of the drum is adjusted when the media items are added to and ejected from the drum while maintaining a constant linear velocity for the drum.

In an embodiment, at 343, an upward position and a downward position of the drum are adjusted when the media items are added to and ejected from the drum while maintaining a constant distance between an outer peripheral surface of the drum to the pinch.

In an embodiment, at 344, the drum is urged downward along a drum lift rack within the escrow module when the media items are added to the drum. Also, the drum is urged upward along the drum lift rack within the escrow module when the media items are ejected and removed from the drum.

Figure 4:
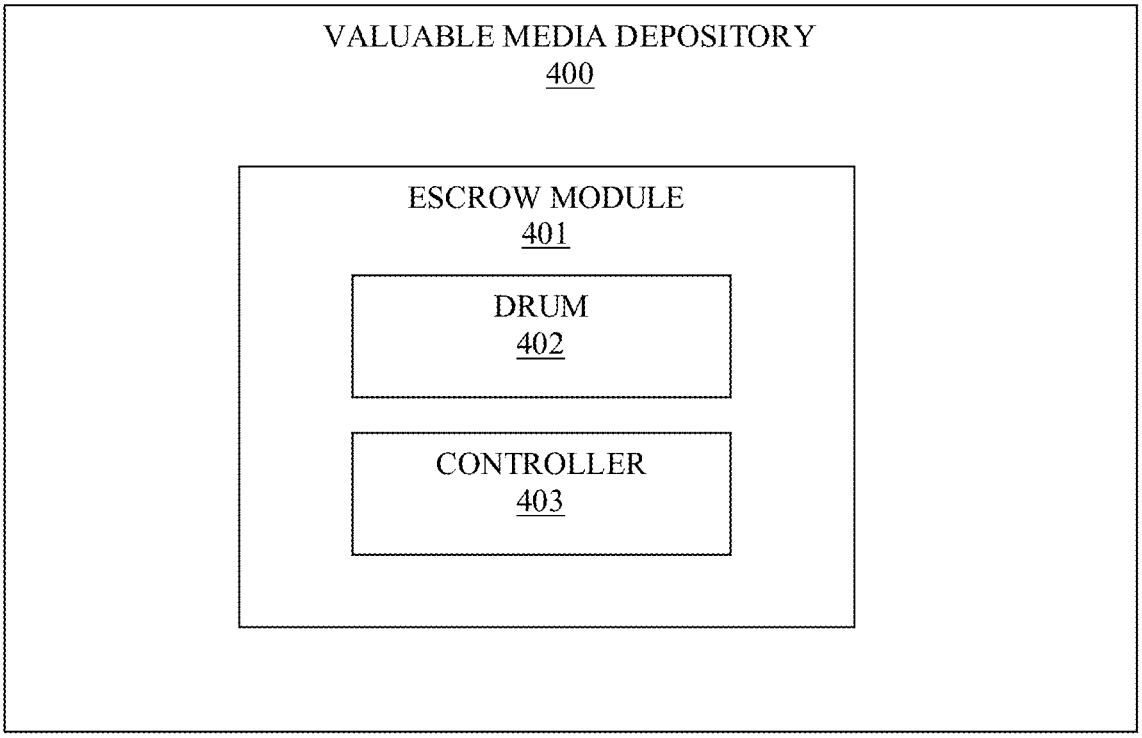
FIG. 4 is a diagram of a valuable media depository with an escrow module having dynamic drum positioning, according to an example embodiment.

FIG. 4 is a media depository 400 with an escrow module configured to perform dynamic escrow drum positioning, according to an example embodiment. The valuable media depository 400 processes valuable media and includes a variety of mechanical, electrical, and software/firmware components, some of which were discussed above with reference to the FIGS. 1A-1F and 2-3.

In an embodiment, the valuable media depository 400 is a deposit module.

In an embodiment, the valuable media depository 400 is a recycler module.

In an embodiment, the valuable media depository 400 is the depository 100.

In an embodiment, the valuable media depository 400 is the depository that performs: any or, some combination of, or all of the processing discussed above in the FIGS. 1A-1F and 2-4.

In an embodiment, the valuable media depository 400 is a peripheral device integrated into an SST. In an embodiment, the SST is an ATM. In an embodiment, the SST is a kiosk.

In an embodiment, the valuable media depository 400 is a peripheral device integrated into a Point-Of-Sale (POS) terminal.

The valuable media depository 400 includes an escrow module 401, a drum 402, and a controller 403.

In an embodiment, the escrow module 401 is the escrow module 140.

The escrow module 401 is configured to: i) dynamically adjust a position of the drum within the escrow module based on a total number of media items on an outer peripheral surface of the drum 402, and ii) maintain a constant distance between the outer peripheral surface to a pinch of the escrow module 401 when the position is dynamically adjusted.

In an embodiment, the escrow module 401 is the escrow module that performs the dynamic drum positioning discussed above in all or some combination of the FIGS. 1A-1F and 2-3.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A method, comprising:

dynamically positioning, by executable instructions that execute on a processor of an escrow module from a non-transitory computer-readable storage medium, a drum of the escrow module as media items are added to the drum and as the media items are removed from the drum based on a total number of the media items that are associated with a transaction being processed and by controlling components of the escrow module to position the drum during the transaction, wherein dynamically positioning further includes driving the drum in a vertical direction upward and downward direction along a drum lift rack to which the drum is attached; and maintaining, by the executable instructions, a constant distance from an outer peripheral surface of the drum adjacent to a pinch of the escrow module as the drum is dynamically positioned.

2. The method of claim 1, wherein dynamically positioning further includes urging the drum upward towards the pinch as the media items are removed from the drum.

3. The method of claim 1, wherein dynamically positioning further includes urging the drum downward away from the pinch as the media items are added to the drum.

4. The method of claim 1, wherein driving further includes driving the drum by a drum lift stepper motor.

5. The method of claim 1, wherein dynamically positioning further includes urging the drum away from the pinch of the escrow module as added ones of the media items cause an increase in a size of a diameter of the drum.

6. The method of claim 1, wherein dynamically positioning further includes urging the drum towards the pinch of the escrow module as removed ones of the media items cause a decrease in a size of a diameter of the drum.

7. A method, comprising:

dynamically positioning, by executable instructions that execute on a processor of an escrow module from a non-transitory computer-readable storage medium, a drum of the escrow module as media items are added to the drum and as the media items are removed from the drum based on a total number of the media items that are associated with a transaction being processed and by controlling components of the escrow module to position the drum during the transaction, wherein maintaining further includes adjusting a drum rotational velocity of the drum as a constant linear velocity as the media items are added and removed from the drum, and wherein adjusting further includes maintaining the drum rotation velocity in a range from 540 rotations per minute (rpm) when the drum is empty having none of the media items to 303 rpm when the drum is full and at capacity with the media items; and maintaining, by the executable instructions, a constant distance from an outer peripheral surface of the drum adjacent to a pinch of the escrow module as the drum is dynamically positioned.

8. A method, comprising:

(i) receiving media items on a drum of an escrow module;

(ii) responsive to the receiving adjusting, by executable instructions that execute on a processor of the escrow module from a non-transitory computer-readable storage medium, the drum downward and away from a pinch of the escrow module based on a total number of the media items associated with a transaction that is being processed and by controlling components of the escrow module that position the drum;

(iii) ejecting, by the executable instructions, the media items off the drum and through the pinch;

(iv) responsive to the ejecting moving, by the executable instructions, the drum upward toward the pinch; and (v) urging, by the executable instructions, the drum downward along a drum lift rack within the escrow module when the media items are added to the drum and urging the drum upward along the drum lift rack within the escrow module when the media items are ejected and removed from the drum.

9. The method of claim 8, wherein (i) further includes adding the media items to an outer peripheral surface of the drum with the media items held by tape to the outer peripheral surface.

10. The method of claim 9, wherein (ii) further includes moving the drum a distance from an original position that maintains a constant distance between the outer peripheral surface and the pinch before and after the media items are added and as a diameter of the drum increases with the media items.

11. The method of claim 8, wherein (iii) further includes ejecting the media items off an outer peripheral surface of the drum.

12. The method of claim 11, wherein (iv) further includes moving the drum a distance from a previous position that maintains a constant distance between the outer peripheral surface and the pinch before and after the media items are ejected and as a diameter of the drum decreases from removal of the media items.

13. The method of claim 8 further comprising: (vi) adjusting, by the executable instructions, a rotational velocity of the drum when the media items are added to and ejected from the drum while maintaining a constant linear velocity for the drum.

14. The method of claim 8 further comprising, (vi) adjusting, by the executable instructions, an upward position and a downward position of the drum when the media items are added to and ejected from the drum while maintaining a constant distance between an outer peripheral surface of the drum to the pinch.

* * * * *